US007021857B2

(12) United States Patent
Van Der Poel

(10) Patent No.: US 7,021,857 B2
(45) Date of Patent: Apr. 4, 2006

(54) DYNAMIC ROAD MARKING SYSTEM AND ROAD SEGMENT PROVIDED WITH SAID SYSTEM

(75) Inventor: Lucas Leo Desiree Van Der Poel, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/243,328

(22) Filed: Sep. 6, 2002

(65) Prior Publication Data

US 2004/0047685 A1 Mar. 11, 2004

(51) Int. Cl.
*E01F 9/00* (2006.01)

(52) U.S. Cl. ..... 404/9; 404/71; 340/932; 701/118

(58) Field of Classification Search ..... 404/1, 404/9, 71; 340/907, 932; 701/1, 118
See application file for complete search history.

(56) References Cited

U.S. PATENT DOCUMENTS 3,078,944 A * 2/1963 Gray ..... 180/167
3,188,927 A * 6/1965 Woods ..... 404/9
3,302,168 A * 1/1967 Gray et al. ..... 340/932
3,544,959 A * 12/1970 Hawks ..... 340/932
3,750,099 A * 7/1973 Proctor ..... 340/932
3,872,423 A * 3/1975 Yeakley ..... 340/932
3,893,000 A * 7/1975 Guercio ..... 315/159
5,109,224 A 4/1992 Lundberg ..... 340/907
5,673,039 A * 9/1997 Pietzsch et al. ..... 340/905
6,305,874 B1 * 10/2001 Custers et al. ..... 404/9
6,587,779 B1 * 7/2003 Kerner et al. ..... 701/117

FOREIGN PATENT DOCUMENTS

WO 0020691 A1 4/2000

* cited by examiner

*Primary Examiner*—Gary S. Hartmann

(57) ABSTRACT

A dynamic road marking system for influencing a flow of traffic has a plurality of road marking units (3, 3', 3", . . . ) provided with a light source emitting light in the direction of a driver of a vehicle (6, 6') traveling over a roadway (10). The road marking unit includes detection apparatus (2) for detecting the intensity of the flow of traffic, and conversion apparatus for converting the detected traffic intensity to a desired traffic intensity with a desired mutual distance between the vehicles (6, 6') and/or a desired velocity of the vehicles (6, 6'). The road marking system generates a guidance light (1, 1', . . . ) which seemingly moves along with the flow of traffic by suitably switching on and off the light source in the road marking units (3, 3', 3", . . . ). The flow of traffic moves along with the moving guidance light (1, 1', . . . ). The speed of the guidance light (1, 1', . . . ) is adapted to the desired mutual distance between the vehicles (6, 6') and/or to the desired velocity of the vehicles (6, 6'). Preferably, guidance lights (1, 1', . . . ) are disposed between each of the vehicles. The dynamic road marking system enables higher traffic intensities on roadways and improved traffic safety. In addition, the road marking system including guidance lights (1, 1', . . . ) facilitates interweaving of vehicles.

2 Claims, 4 Drawing Sheets

DYNAMIC ROAD MARKING SYSTEM AND ROAD SEGMENT PROVIDED WITH SAID SYSTEM

BACKGROUND OF THE INVENTION

The invention relates to a dynamic road marking system for influencing a flow of traffic consisting of vehicles traveling over a roadway, which road marking system comprises a plurality of road marking units, and each one of the road marking units is provided with a light source for emitting light in the direction of a driver of one of the vehicles.

The invention further relates to a road segment comprising a first roadway and an adjoining second roadway, at least two successive vehicles traveling over the first roadway, and at least one further vehicle traveling over the second roadway, and at least the first roadway being provided with the road marking system.

The invention also relates to a system for marking roads comprising one or more road marking systems, a control system for the road marking systems and means for coupling the road marking systems to the control system.

Such road marking systems are used in traffic control systems for marking traffic routes for vehicles, such as roads for cars and other road users. One of the methods used by traffic planners in their attempts to reduce traffic jams is a so-called "tidal flow system". In such a dynamic system, the direction of the traffic of multi-lane roads is changed for one or more lanes in accordance with the direction of the main flow of traffic. In an alternative embodiment, the number of lanes available to traffic moving in a specific direction is increased or reduced, dependent upon the amount of traffic. A problem with these methods relates to indicating, in a flexible manner, the direction of the desired flow of traffic for a specific lane, or to changing the arrangement of the traffic route in a flexible manner. Known means for indicating the desirable direction of the flow of traffic include signaling lights beside or above the traffic route.

Such road marking systems cannot only be used as dynamic road marking systems, they can also be given static applications. Static applications of road marking systems include the marking of parts of traffic routes (for example straight parts or bends) so as to control the direction of the traffic under certain weather conditions, for example during fog, rain, black ice, etc., and/or under certain light conditions, such as daylight, twilight, a low position of the sun, night, etc.

Road marking systems can be provided in a road surface of the traffic route but also beside and/or above the traffic route, for example on a crash barrier at the side of the traffic route.

A road marking system of the type mentioned in the opening paragraph is disclosed in WO 00/20691 (PHN17.533). In said document, a description is given of a system for creating marking lines in a road surface by means of light originating from suitable light sources provided in road marking units, said marking lines being visible at some distance from the vehicle and being perceived as full or interrupted marking lines. In the known road marking system it is achieved that a driver of a vehicle, for example a motorist or a truck driver who, from his vehicle, looks ahead at the traffic on the road and the markings in the road surface, observes at some distance that the light beams originating from the road marking units demonstrate a uniform overlap. The light originating from the road marking units is perceived as an imaginary full marking line under said conditions.

A drawback of the known road marking system resides in that said road marking system cannot be used to influence a flow of traffic consisting of vehicles traveling over a roadway.

SUMMARY OF THE INVENTION

It is an object of the invention to provide a road marking system of the type described in the opening paragraph, which obviates said drawback.

In accordance with the invention, this object is achieved in that the road marking system comprises detection means for detecting the intensity of the flow of traffic, the road marking system includes conversion means for converting the detected intensity of the flow of traffic to a desired intensity of the flow of traffic and a desired distance between the vehicles and/or a desired speed of said vehicles, and the road marking system generates a guidance light which seemingly moves along with the flow of traffic and is generated by suitably switching on and off the light source in the road marking units so as to cause the flow of traffic to move along with the guidance light, the speed of said guidance light being in accordance with the desired mutual distance between the vehicles and/or with the desired speed of the vehicles.

By means of the measure in accordance with the invention, it is achieved that a driver, for example a motorist or a truck driver who, from his vehicle, looks ahead at the traffic on the road, observes a guidance light in front of his car, which guidance light seemingly moves along with the flow of traffic. Said guidance light is situated between the driver's vehicle and the vehicle in front of the driver's vehicle in the flow of traffic. By gradually changing the speed of the guidance light, thus causing the vehicles to adapt their speed, a safe distance between the vehicles and/or a safe intensity of the vehicles in the flow of traffic is achieved.

The detection means comprise means which are known per se, such as an (induction) loop or a combination of (induction) loops in the road surface, by means of which the traffic intensity is measured. An alternative embodiment of the detection means comprises a camera or a set of cameras monitoring the flow of traffic. The traffic intensity can be observed also by an observer. Measuring the traffic intensity includes, for example, determining the number of vehicles present at a specific road segment per unit of time. Detecting the flow of traffic preferably also includes detecting the average speed of the vehicles traveling over this road segment.

The conversion means comprise means which are known per se for converting the intensity of the flow of traffic detected by the detection means to a desired intensity of the flow of traffic and a desired mutual distance between the vehicles and/or a desired speed of the vehicles. The desired distance between the vehicles is also referred to as "target distance". The desired speed of the vehicles is also referred to as "target speed". By means of traffic intensity computer models, which are known per se, it is possible to determine a safe mutual distance between the vehicles and/or a safe speed of the vehicles on the basis of the measured intensity of the flow of traffic. By optimizing the traffic intensity generated by the conversion means, the traffic capacity can be suitably enlarged.

As the dynamic road marking system in accordance with the invention can be used to influence the mutual distance or speed of vehicles, it can also suitably be employed to increase traffic safety in the case of fog and other conditions wherein visibility is substantially reduced. By gradually changing the speed of the guidance light generated by the dynamic road marking system between two successive vehicles and/or gradually changing the distance between successive guidance light, the vehicles gradually adapt their speed and their mutual distance, as a result of which, given the measured intensity of the flow of traffic, a safe distance between the vehicles and/or a safe speed of the vehicles in the flow of traffic is achieved.

The dynamic road marking system is preferably provided in the road surface. The light source generating the guidance light preferably comprises a plurality of light sources (for example 4, 8, 10, 15 or 20 LEDs) which are arranged next in the road surface, next to each other and transversely to the driver's direction of view. Said light sources are so closely spaced that they cannot be individually distinguished by the human eye. The guidance light preferably comprises colored light, for example amber or green. It is particularly suitable if the color of the guidance light can be adapted to the intensity of the flow of traffic.

The dynamic road marking system is preferably provided approximately in the center of the roadway or lane. This has the advantage that this location is suitable for giving visual information because the driver generally looks straight ahead. In addition, the other, mostly painted, road marking can be preserved. Besides, a road marking system provided in the center of the roadway or lane is subject to a comparatively small mechanical load.

To create the impression that the guidance light moves along with the flow of traffic, the light source in successive road marking units is switched on and off. If the speed of the guidance light is high, the road marking units can also be switched alternately, for example only the even road marking units are switched on and off.

To lend the guidance light a seemingly continuous appearance, a distance d between two successive road marking units preferably lies in the range from $10 \leqq d \leqq 50$ cm. If the distance d is smaller than 10 cm, a large number of road marking units (and associated light sources) is necessary to achieve the desired effect. If the distance between two successive road marking units is above 50 cm, the coherence of the light sources is such that they are no longer perceived as forming a coherent guidance light by the road user. A particularly suitable distance d between two successive road marking units lies in the range between 15 and 20 cm.

A preferred embodiment of the dynamic road marking system in accordance with the invention is characterized in that the road marking system generates a plurality of guidance lights so as to make sure that at least one guidance light is visible between each one of the vehicles. This enables the speed of and/or the mutual distance between a large number of vehicles forming part of a flow of traffic and traveling over this road segment, to be influenced by the road marking system.

An alternative embodiment of the dynamic road marking system in accordance with the invention is characterized in that the road marking system generates a plurality of guidance lights so as to make sure that at least two guidance lights are visible between two successive vehicles. This enables the speed of and/or the mutual distance between a large number of vehicles forming part of a flow of traffic and traveling over this road segment, to be influenced by the road marking system. In addition, the mutual distance between the two guidance lights visible between two successive vehicles enables additional space to be created between said two vehicles.

Preferably, the distance between the two guidance lights that are visible between two successive vehicles is sufficiently large to admit a vehicle originating from a different roadway to filter in between the two successive vehicles. In this situation, the dynamic road marking system helps drivers to join the flow of traffic, which is commonly referred to as "interweaving". Interweaving means that two flows of traffic which come together integrate into one flow of traffic. This situation occurs, in practice, at the location of an acceleration lane or at locations where two roadways or lanes come together, so that vehicles from various roadways or lanes are joined on a smaller number of roadways or lanes. A well-known phenomenon in the case of "interweaving" is that vehicles of one flow of traffic tend to drive to close together, thereby giving the flow of traffic that tries to filter in insufficient room to do so. In general, vehicles can only drive close together if the drivers reduce the speed of their vehicle. Such comparatively low speeds often give rise to traffic jams with delays at a location where interweaving should take place. By using a road marking system as described hereinabove, interweaving is made easier while the speed of the vehicles in the flows of traffic coming together can remain comparatively high. In addition, said road marking system enhances traffic safety.

The invention particularly relates to influencing traffic flows at locations where interweaving is to take place.

A number of the road marking units of the road marking system can jointly form a robust, solidly constructed base module. Such base modules can be readily produced and provided bodily in (the center of) the roadway, preferably when the road is under construction. In addition, the electric conductors or the light guides, which generate the light for the light sources, can be readily provided on or in a side of the base module facing away from the light source. The use of a base module has the further advantage that it is not necessary to provide, for each road marking unit, a connection to the (light) generator underneath or in the road surface; instead, one connection to the (light) generator is provided for each base module comprising a number of road marking units.

The road marking units, or the base modules, are preferably fitted in the road surface. If the base module is largely provided in the road surface, said base module is effectively protected against wear. Since only a comparatively small part of the base module is situated at the surface of the road, the material used for the base module and said small part at the surface do not have to meet the anti-skid requirements imposed on a road surface. To protect the light source(s), they are preferably recessed in the road marking units.

For the light source use is preferably made of a light-emitting diode (LED). Preferably, the luminous flux of the light-emitting diode is at least 5 lm during operation. Light-emitting diodes, also referred to as optoelectronic elements or electro-optic elements, can particularly suitably be used as the light source. The light-emitting diode element is preferably mounted in the road marking unit. A comparatively high luminous flux is necessary to generate enough light also in ambient light conditions, such as sunlight or light originating from headlights, so that the light beam is noticeable from a distance.

As an alternative light source for use in the road marking system, use can very suitably be made of an end portion of an optical fiber. This has the advantage that the light emitted by the light source is generated in a light generator at a distance from the road marking unit and transferred from the light generator to the light source by means of optical fibers. The light generator may comprise a light source accommodated in the housing, for example a semiconductor light source such as a light-emitting diode, or a discharge lamp such as a mercury discharge lamp. In an attractive variant of this embodiment, the light generator comprises a first end of at least one light guide, which light guide is optically coupled, at a second, opposite end, to the light source in the road marking unit. The light source in the light generator is preferably arranged at a distance from the road marking unit so that said light source can be readily replaced, for example at the end of its service life. An advantage of employing optical light guides is that the use of optical fibers results in a very efficient use of light, which entails no, or at least very little, luminous pollution. Luminous pollution is to be taken to mean the loss of light caused by the fact that areas are illuminated at locations where illumination is not necessary and/or undesirable. An advantage of the use of optical light guides with respect to the use of light emitting diodes is that in the case of optical fibers, no electric voltages and currents have to be fed to the light source via the road surface. This results in increased traffic safety. Also in the case of accidents and other calamities, the risk of an electric voltage flashover or a short-circuit, which might cause an undesirable explosion, is precluded.

In an attractive, alternative embodiment of the road marking system in accordance with the invention, the light generator comprises a housing which accommodates a light source as well as an optical system for directing the radiation to be generated by the light source, said light source comprising a plurality of light-emitting diodes, and said light generator being provided with control electronics for operating the light-emitting diodes. Preferably, the optical system comprises a collimator lens with, optionally, a number of sub-lenses, the optical axis of each of the sub-lenses coinciding with the optical axis of one or the light-emitting diodes, and the optical system also comprises a focusing lens. The focusing lens is preferably embodied so as to be a (positive) Fresnel lens. The advantage of using a light generator based on light-emitting diodes is that the housing of the light generator is completely closed. As a result of the long service life of the light-emitting diodes, the light source does not have to be replaced during the service life of the light generator. This favorable property enables the light generator to form part of the base module, so that the length of the necessary light guides can be reduced substantially. A further advantage of a light generator on the basis of light-emitting diodes is that such a light generator has a high resistance to shocks. Furthermore, the control electronics enables the light to be dimmed or change color in a simple manner, for example by switching on or off specific light-emitting diodes. In addition, a light generator on the basis of light-emitting diodes has a high luminous efficiency.

The invention further relates to a road segment as mentioned in the opening paragraph. The road segment is characterized in accordance with the invention in that a continuous marking line extends between the first and the second roadway as long as the distance between two successive vehicles traveling over the first roadway is insufficient, and as soon as the distance between two successive vehicles traveling over the first roadway is sufficient, the continuous marking line between the first and the second roadway changes to a discontinuous marking line so as to allow the further vehicle traveling over the second roadway to join the traffic traveling over the first roadway.

As long as the flows of traffic traveling over the first and the second roadway cannot be integrated ("interweaving"), in accordance with the invention, a continuous marking line extends between the two roadways. As soon as, as a result of the road marking system comprising the guidance lights that move along with the traffic, the distance between the two successive vehicles traveling over the first roadway is sufficient, the continuous marking line changes to a discontinuous marking line.

The conversion from continuous to discontinuous marking line, and vice versa, can also take place in dependence upon the desired distance between the successive vehicles traveling over the first roadway. To this end, a preferred embodiment of the road segment is characterized in accordance with the invention in that the marking line extending between the first and the second roadway is embodied so as to be a further road marking system comprising a plurality of further road marking units, each of said further road marking units being provided with a further light source for emitting light in the direction of the drivers of the vehicles, and the continuous marking line or the discontinuous marking line between the first and the second roadway being brought about by suitably switching on and off the light source in the road marking units.

In this manner, a dynamic marking line is obtained having the appearance of a continuous marking line as long as the mutual distance between the vehicles traveling over the first roadway is too small or the speed of the vehicles traveling over the first roadway is too high to enable safe interweaving.

Preferably, both the first and the second roadway are provided with a dynamic road marking system. This enables the flow of traffic on both roadways to be influenced so as to optimize the circulation of traffic. By providing the road marking systems in accordance with the invention, the traffic capacity of the road segment is increased and the safety of the flows of traffic is favorably influenced.

The invention further relates to a road marking system which is provided with one or more road marking systems in accordance with the invention, a control system for the road marking systems, and means for coupling the road marking systems to the control system. The means for coupling the one or more road marking systems to the control system may be embodied so as to be a cable for guiding electrical or optical signals. In a variant, the means for coupling are embodied so as to be a wireless connection by means of an emitter/receiver pair, wherein the emitter sends control signals from the control system to a receiver incorporated in the road marking system.

These and other aspects of the invention will be apparent from and elucidated with reference to the embodiment(s) described hereinafter.

BRIEF DESCRIPTION OF THE DRAWING

The Figures are purely diagrammatic and not drawn to scale. Particularly for clarity, some dimensions are exaggerated strongly. In the drawings, like reference numerals refer to like parts whenever possible.

DESCRIPTION OF EXAMPLARY EMBODIMENTS

Figure 1:
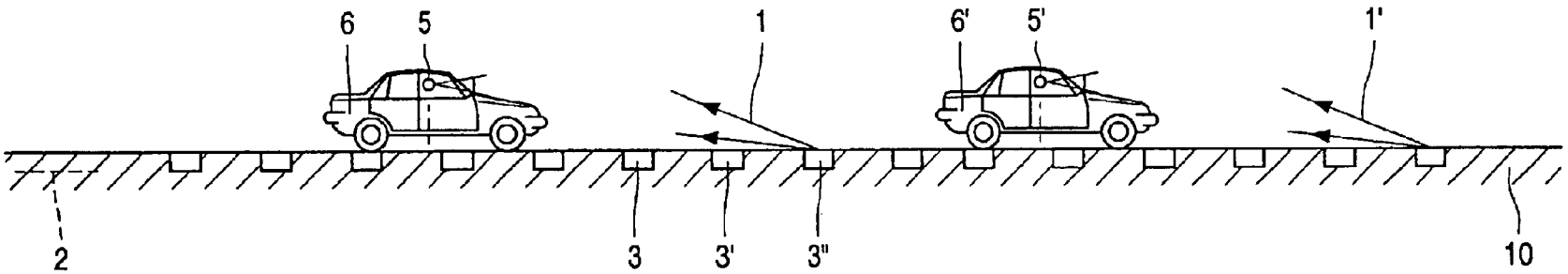
FIG. 1 is a cross-sectional view of a dynamic road marking system in accordance with the invention.

FIG. 1 is a cross-sectional view of a dynamic road marking system for influencing a flow of traffic consisting of vehicles 6, 6', . . . traveling over a roadway 10. The road marking system comprises a plurality of road marking units 3; 3', 3", . . . . Each one of said road marking units 3, 3', 3", . . . is provided with a light source (not shown in FIG. 1) for emitting light in the direction of a driver 5, 5', . . . of one of the vehicles 6, 6', . . . . In accordance with the measure of the invention, the road marking system includes detection means 2 for detecting the intensity of the flow of traffic. The detection means 2 comprise means which are known per se, such as an (induction) loop or a combination of (induction) loops in the road surface, by means of which traffic intensity is measured. The road marking system further comprises conversion means (not shown in FIG. 1) for converting the detected intensity of the flow of traffic to a desired intensity of the flow of traffic with a desired mutual distance between the vehicles 6, 6' and/or a desired speed of said vehicles 6, 6'.

In the situation shown in FIG. 1, two guidance lights 1, 1', . . . which seemingly move along with the flow of traffic are generated by suitably switching on and off the light source in the road marking units 3, 3', 3", . . . . In the example shown in FIG. 1, road marking unit 3" emits light in the direction of driver 5 of vehicle 6 at a certain point in time. By suitably switching on and off the light source in the road marking units 3, 3', 3", . . . it is achieved that the flow of traffic moves along with the guidance lights 1, 1', . . . , the speed of said guidance lights 1, 1', . . . moving along with the flow of traffic corresponding to the desired distance between the vehicles 6, 6' and/or the desired speed of the vehicles 6, 6'.

Preferably, the light emitted by the guidance lights 1, 1', . . . in the direction of the driver 5, 5', . . . is colored in dependence of the angle under which the light is emitted. This is advantageous because the light appears to have different colors depending in the distance of the vehicles 6, 6' . . . to the road marking units 3, 3', 3", . . . . If the vehicle is too close to the guidance light, the emitted light may e.g. be red or orange, whereas in case the distance between the guidance light and the vehicle is in the desired range, the emitted light may be green. Additional coloring of the light emitted by the guidance lights 1, 1', . . . further improves the safety of the dynamic road marking system.

Figure 2A:
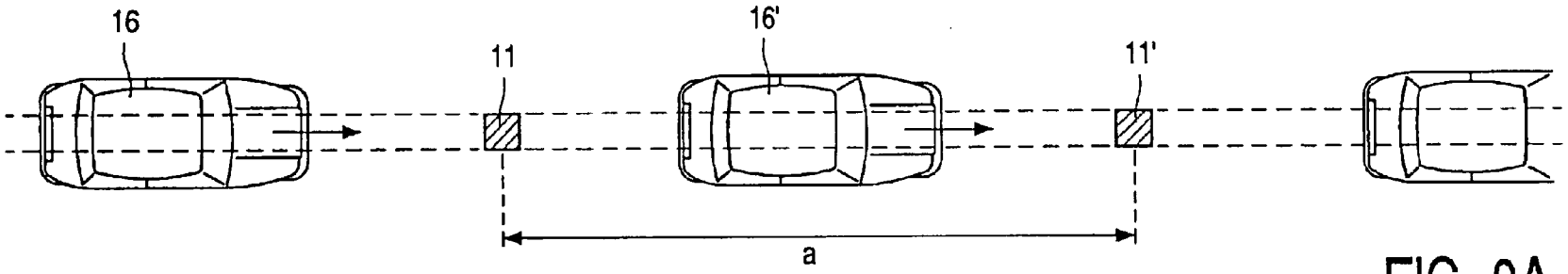
FIGS. 2A, 2B and 2C are plan views of an embodiment of the dynamic road marking system, wherein two guidance lights moving along with the traffic are generated, and the mutual distance between the guidance lights increases gradually.
Figure 2B:
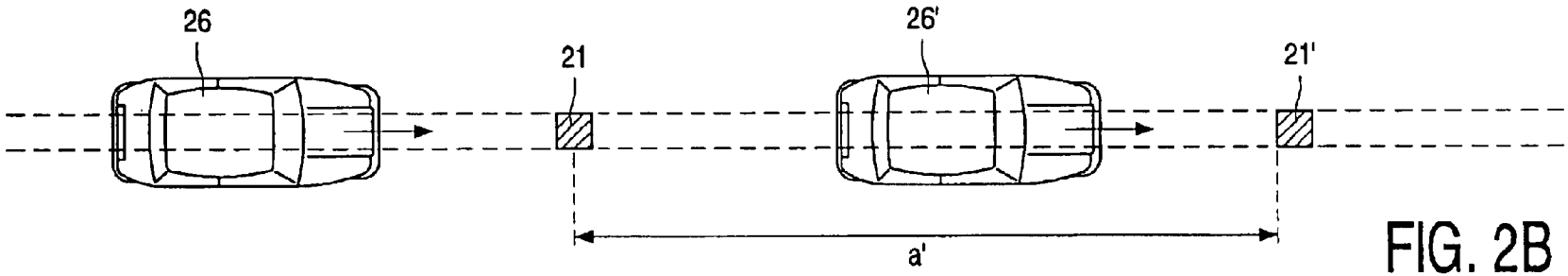
Figure 2C:
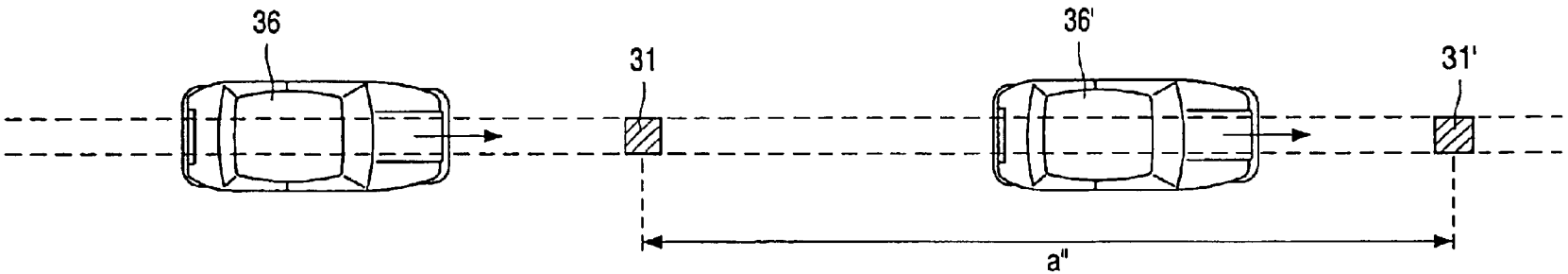

FIGS. 2A, 2B and 2C are plan views of an embodiment of the dynamic road marking system, wherein two guidance lights moving along with the flow of traffic are generated, and the mutual distance between the guidance lights increases gradually. The direction of the vehicles 16, 16'; 26, 26'; 36, 36' is indicated by means of an arrow. FIGS. 2A, 2B and 2C show the flow of traffic at different points in time.

In the situation shown in FIG. 2A, two guidance lights 11, 11', . . . which seemingly move along with the flow of traffic are generated by suitably switching on and off the light source in the road marking units (not shown in FIG. 2A). By suitably switching on and off the light source in the road marking units it is achieved that the flow of traffic moves along with the guidance lights 11, 11', . . . , the speed of said guidance lights 11, 11', . . . moving along with the flow of traffic corresponding to the desired distance between the vehicles 16, 16' and/or to the desired speed of the vehicles 16, 16'. In the situation shown in FIG. 2A, the distance between the guidance lights 11, 11', . . . is indicated by means of a. In FIG. 2A, the guidance lights 11, 11', . . . form part of the dynamic road marking system which is diagrammatically shown by means of dashed lines. In FIG. 2A, the dynamic road marking system is provided in the middle of the roadway.

In the situation shown in FIG. 2B, two guidance lights 21, 21', . . . which seemingly move along with the flow of traffic are generated by suitably switching on and off the light source in the road marking units (not shown in FIG. 2B). By suitably switching on and off the light source in the road marking units, it is achieved that the flow of traffic moves along with the guidance lights 21, 21', . . . , the speed of the guidance lights 21, 21', . . . moving along with the flow of traffic corresponding to the desired distance between the vehicles 26, 26' and/or to the desired speed of the vehicles 26, 26'. In the situation shown in FIG. 2B, the distance between the guidance lights 21, 21', . . . is indicated by means of a'.

In the situation shown in FIG. 2C, two guidance lights 31, 31', . . . which seemingly move along with the flow of traffic are generated by suitably switching on and off the light source in the road marking units (not shown in FIG. 2C). By suitably switching on and off the light source in the road marking units it is achieved that the flow of traffic moves along with the guidance lights 31, 31', . . . , the speed of the guidance lights 31, 31', . . . moving along with the flow of traffic corresponding to the desired distance between the vehicles 36, 36' and/or to the desired speed of the vehicles 36, 36'. In the situation shown in FIG. 2C, the distance between the guidance lights 31, 31', . . . is indicated by means of a". By gradually changing the speed of the guidance lights 11, 11', . . . ; 21, 21', . . . ; 31, 31', . . . , generated by the dynamic road marking system between two successive vehicles 16, 16'; 26, 26'; 36, 36' and/or by gradually changing the distance between successive guidance lights 11, 11', . . . ; 21, 21', . . . ; 31, 31', . . . , the vehicles 16, 16'; 26, 26'; 36, 36' gradually adapt their speed and their mutual distance, as a result of which, given the measured intensity of the flow of traffic, a safe distance between the vehicles 16, 16'; 26, 26'; 36, 36' and/or a safe speed of the vehicles in the flow of traffic is achieved.

The example of FIGS. 2A, 2B, and 2C shows that the distance a" between the guidance lights 31 and 31' in FIG. 2C is larger than the distance a' between the guidance lights 21 and 21' in FIG. 2B, which is larger than the distance a between the guidance lights 11 and 11' in FIG. 2A.

Figure 3A:
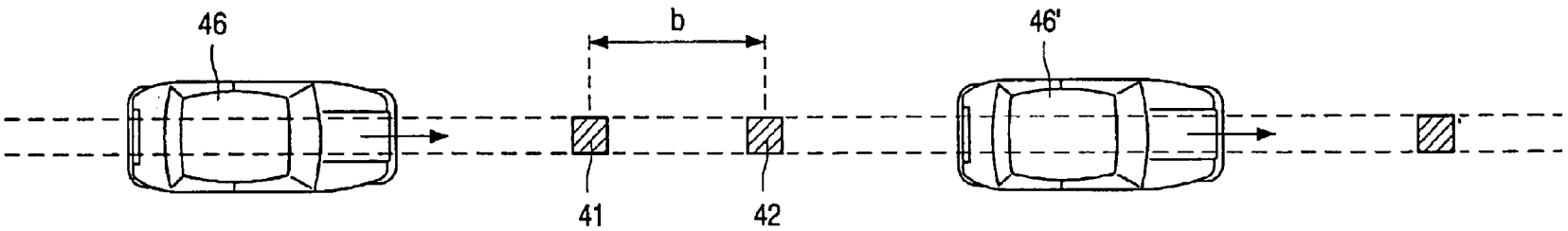
FIGS. 3A and 3B are plan views of an alternative embodiment of the dynamic road marking system, wherein, between two vehicles, two guidance lights moving along with said vehicles are generated, and the mutual distance between the two guidance lights increases gradually.
Figure 3B:
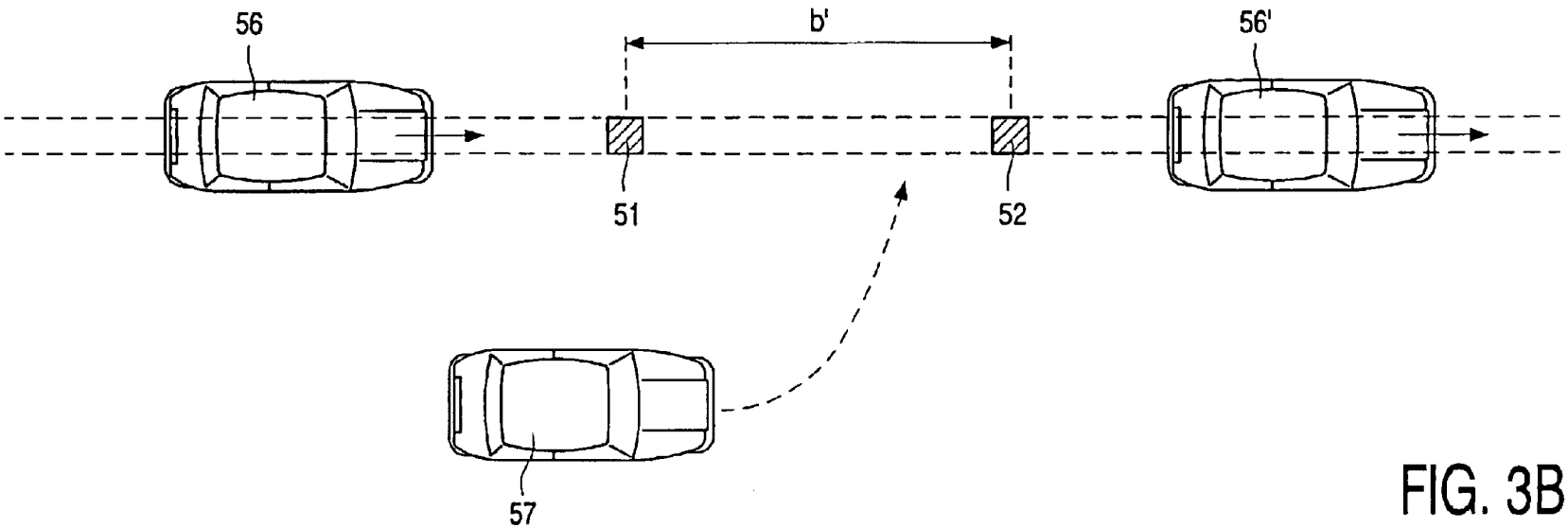

FIGS. 3A and 3B are plan views of an alternative embodiment of the dynamic road marking system wherein, between two successive vehicles 46, 46'; 56, 56', two guidance lights 41, 42; 51; 52 moving along with said vehicles are generated, and wherein the mutual distance between the two guidance lights 41, 42; 51; 52 gradually increases. FIGS. 3A and 3B show the flow of traffic at successive points in time.

In the situation shown in FIG. 3A, two guidance lights 41, 42 which seemingly move along with the flow of traffic are generated between two vehicles 46, 46' by suitably switching on and off the light source in the road marking units (not shown in FIG. 3A). By suitably switching on and off the light source in the road marking units, it is achieved that the flow of traffic moves along with the guidance lights 41, 42. In the situation shown in FIG. 3A, the distance between the guidance lights 41, 42 is indicated by means of b.

In the situation shown in FIG. 3B, two guidance lights 51, 52 which seemingly move along with the flow of traffic are generated between two vehicles 56, 56' by suitably switching on and off the light source in the road marking units (not shown in FIG. 3B). By suitably switching on and off the light source in the road marking units, it is achieved that the flow of traffic moves along with the guidance lights 51, 52. In the situation shown in FIG. 3B, the distance between the guidance lights 51, 52 is indicated by means of b'.

The example shown in FIGS. 3A and 3B illustrates that the distance b' between the guidance lights 51 and 52 in FIG. 3B is larger than the distance b between the guidance lights 41 and 42 in FIG. 3A. If the distance between the two guidance lights 51, 52 is sufficient, then the space between two successive vehicles 56, 56' is sufficiently large to allow a vehicle 57 originating from a different roadway to merge in. A vehicle 57 merging in between the vehicles 56, 56' is diagrammatically indicated by means of a dashed arrow.

Figure 4:
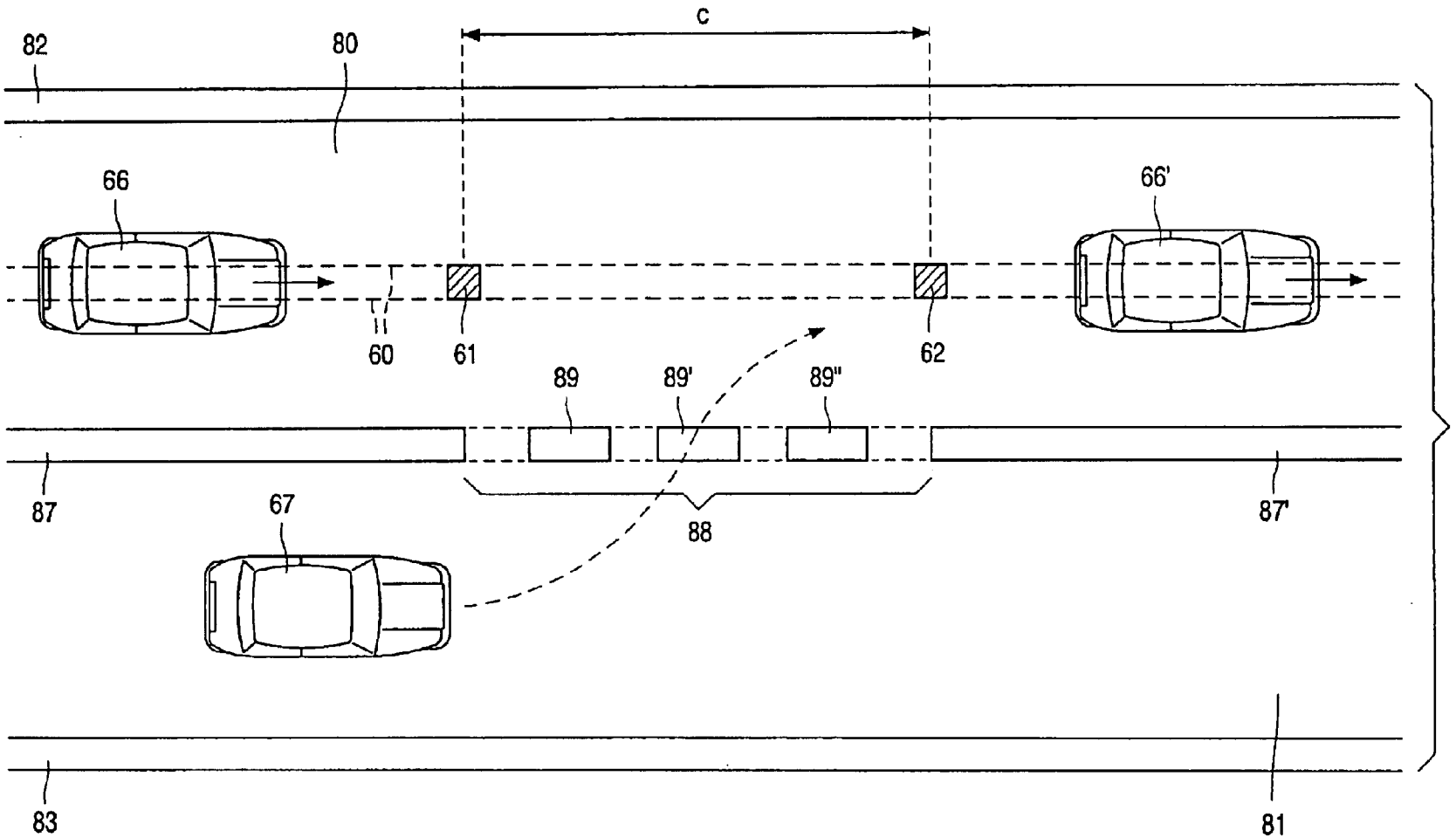
FIG. 4 is a plan view of an embodiment of a road segment in accordance with the invention comprising two roadways.

FIG. 4 is a plan view of an embodiment of a road segment in accordance with the invention, comprising a first roadway 80 and an adjoining second roadway 81. In the example shown in FIG. 4, the edges of the roadways 80, 81 are provided with continuous marking lines 82, 83. At least two successive vehicles 66, 66' travel over the first roadway 80, and at least one further vehicle 67 travels over the second roadway 81. In the example shown in FIG. 4, the first roadway 80 is provided with the road marking system 60 in accordance with the invention described hereinabove. As long as the distance between two successive vehicles 66, 66' traveling over the first roadway 80 is insufficient, a continuous marking line 87, 87" extends between the first and the second roadway 80; 81. FIG. 4 shows the situation where the distance (indicated by means of c) between said two successive vehicles 66, 66' traveling over the first roadway 80 is sufficient to allow the further vehicle 67 originating from the second roadway 81 to merge into the traffic traveling over the first roadway 80. To admit the further vehicle 67 to the first roadway 80, the continuous marking line 87, 87' extending between the first and the second roadway 80; 81 has been changed to a discontinuous marking line 81 at the merge-in location. The discontinuous marking line 88 comprises, in the example shown in FIG. 4, a plurality of short marking lines 89, 89', 89", . . . .

In the example shown in FIG. 4, the marking line 87, 87', 88 extending between the first and the second roadway (80, 81) is embodied so as to be a further road marking system comprising a plurality of further road marking units (not shown in FIG. 4). Each one of the further road marking units is provided with a further light source (not shown in FIG. 4) to emit light in the direction of the drivers of the vehicles 66, 66', 67. By suitably switching on and off the light source in the road marking units, the further road marking system brings about the continuous marking line 87, 87' and the discontinuous marking line 88 between the first and the second roadway 80, 81. The discontinuous marking line 88 comprises, in the example shown in FIG. 4, a plurality of short marking lines 89, 89', 89", . . . .

It will be obvious that, within the scope of the invention, many variations are possible to those skilled in the art.

The scope of protection of the invention is not limited to the examples described hereinabove. The invention is embodied in each novel characteristic and each combination of characteristics. Reference numerals in the claims do not limit the scope of protection thereof. The use of the term "to comprise" does not exclude the presence of elements other than those stated in the claims. The use of the article "a" or "an" in front of an element does not exclude the presence of a plurality of such elements.

What is claimed is:

1. A road segment comprising a first roadway (80) and an adjoining second roadway (81), said road segment being adapted to facilitate merging of at least two successive vehicles (66, 66') traveling over the first roadway (80) with at least one further vehicle (67) traveling over the second roadway (81), at least the first roadway (80) being provided with a road marking system (60) comprising a plurality of road marking units (3, 3', 3". . . ), each one of the road marking units (3, 3', 3", . . . ) being provided with a light source for emitting light in the direction of a driver (5, 5', . . . ) of one of the vehicles (6, 6', . . . ), the road marking system including detection means (2) for detecting the flow of traffic and conversion means for converting the detected flow of traffic to a desired distance between the vehicles (6, 6'; 16, 16'; 26, 26'; 36, 36') and a desired speed of said vehicles (6, 6'; 6, 16'; 26, 26'; 36, 36'), said road marking system generating a guidance light (1, 1', . . . ; 11, 11', . . . ; 21, 21', . . . ; 31, 31', . . . ) which seemingly moves along with the flow of traffic and is generated by switching the light sources in the road marking units (3, 3', 3", . . . ) so as to cause the flow of traffic to move along with the guidance light (1, 1', . . . ; 11, 11', . . . ; 21, 21', . . . ; 31, 31', . . . ) said guidance light (1, 1', . . . , 11, 11', . . . ; 21, 21', . . . ; 31, 31', . . . ) indicating the desired mutual distance between the vehicles (6, 6'; 16, 16', 26, 26'; 36, 36') and the desired speed of the vehicles (6, 6'; 16, 16'; 25, 25'; 36, 36')

a road marking system further generating a continuous marking line (87, 87') extending between the first and the second roadway (80; 81) as long as the distance between two successive vehicles (66, 66') traveling over the first roadway (80) is insufficient to permit said merging but, when the distance between the two successive vehicles (66, 66') traveling over the first roadway (80) is sufficient to permit said merging, changing the continuous marking line (87, 87') between the first and the second roadway (80; 81') to a discontinuous marking line (88) so as to allow the further vehicle (67) traveling over the second roadway (81) to merge with the traffic traveling over the first roadway (80).

2. A road segment as claimed in claim 1, characterized in that the marking line (87, 88) extending between the first and the second roadway (80, 81) is embodied so as to be a further road marking system comprising a plurality of further road marking units, each of said further road marking units being provided with a further light source for emitting light in the direction of the drivers of the vehicles (66, 66', 67), and the continuous marking line (87, 87') or the discontinuous marking line (88) between the first and the second roadway (80, 81) being brought about by suitably switching on and off the light source in the road marking units.

* * * * *